US005318691A

United States Patent [19]

Muldowney

[11] Patent Number: 5,318,691

[45] Date of Patent: Jun. 7, 1994

[54] FCC RISER CRACKING WITH VORTEX CATALYST/OIL MIXING

[75] Inventor: Gregory P. Muldowney, Glen Mills, Pa.

[73] Assignee: Mobil Oil Corporation, Fairfax, Va.

[21] Appl. No.: 61,404

[22] Filed: May 13, 1993

[51] Int. Cl.[5] ..... C10G 11/18; C10G 35/04

[52] U.S. Cl. ..... 208/113; 208/146; 208/157; 208/164

[58] Field of Search ..... 208/164, 127, 157, 146, 208/113, 158, 156, 153, 120; 422/140, 146

[56] References Cited

U.S. PATENT DOCUMENTS

| | | | |
|---|---|---|---|
| 3,551,513 | 12/1979 | Suzukawa et al. | 208/158 |
| 4,427,537 | 1/1984 | Dean et al. | 208/120 |
| 4,808,383 | 2/1989 | Buyan et al. | 422/140 |
| 5,108,583 | 4/1992 | Keon | 208/157 |
| 5,139,748 | 8/1992 | Lomas et al. | 422/140 |

OTHER PUBLICATIONS

White, Frank H. "*Fluid Mechanics*" 1979, McGraw Hill pp. 278-279, 402-403, 357-358.

"50 Years of Catalytic Cracking", Oil & Gas Journal, Week of Jan. 8, 1990.

"Development of Catalytic Cracking Technology. A Lesson in Chemical Reactor Design", A. Avidan and R. Shinnar, Ind. Eng. Chem. Res. 1990, 29, 931-942.

*Primary Examiner*—R. Bruce Breneman
*Assistant Examiner*—Bekir L. Yildirim
*Attorney, Agent, or Firm*—Alexander J. McKillop; Malcolm D. Keen; Richard D. Stone

[57] ABSTRACT

A process and apparatus for mixing feed and catalyst in the base of a fluidized catalytic cracking (FCC) reactor are disclosed. Regenerated catalyst flows through an annular region into a deceleration zone of increased cross-sectional area which induces vortices of circulating catalyst. Liquid feed is injected into the vortices, preferably via radially distributed feed outlets on a centrally mounted, truncated cone injector support means having a vortex convergence prevention means just above the feed outlets. Preferably catalyst and feed accelerate from the mixing device into the base of a riser reactor.

19 Claims, 5 Drawing Sheets

FCC RISER CRACKING WITH VORTEX CATALYST/OIL MIXING

BACKGROUND OF THE INVENTION

This invention relates to fluid catalytic cracking.

BACKGROUND OF THE INVENTION

Many refineries devote extraordinary amounts of energy and operating expense to convert most of a whole crude oil feed into high-octane gasoline. The crude is fractionated to produce a virgin naphtha fraction which is usually reformed, and a gas oil and/or vacuum gas oil fraction which is catalytically cracked to produce naphtha and light olefins. The naphtha is added to the refiner's gasoline blending pool, while the light olefins are converted, usually by HF or sulfuric acid alkylation, into additional gasoline boiling range material for the blending pool.

Catalytic cracking started as a fixed bed process, evolved to a moving bed process, and finally became a fluid bed process. There was considerable competition and overlap as each improvement displaced earlier cracking configurations. The fluid bed process itself has undergone considerable evolution, going from folded riser cracking with limited conversion and 10 to 60 seconds of residence time, to dense bed cracking with increased conversion and residence time, to riser cracking with high conversion and 1 to 10 seconds of residence time.

The fate of fixed bed and moving bed cracking was sealed with the advent of zeolite based cracking catalyst, which revolutionized the industry in the 1960s. High activity zeolite catalyst, with several orders of magnitude more activity than amorphous catalyst, made short contact time all-riser cracking the standard for new construction. Today no fixed bed cracking units operate. Moving bed cracking units are no longer built, and refiners have converted essentially all earlier cracking units into riser units.

The fluid catalytic cracking (FCC) process is now the preferred process in the petroleum refining industry for converting higher boiling petroleum fractions into lower boiling products, especially gasoline. A finely divided solid cracking catalyst, typically with particles of 20–100 microns and an average of 60–75 microns, promotes the reactions. When mixed with gas the catalyst flows like a fluid (hence the designation FCC) and circulates in a closed loop between a cracking zone and a separate regeneration zone.

In FCC, fresh feed contacts hot catalyst from the regenerator in a cracking reactor. The cracking products are separated from the spent (coked) solids and sent to a main fractionator which produces several product streams including gasoline and cycle oil. The catalyst is regenerated to remove the coke, and reused.

A further description of the catalytic cracking process may be found in the monograph, "Fluid Catalytic Cracking with Zeolite Catalysts", Venuto and Habib, Marcel Dekker, New York, 1978, incorporated by reference.

One of the most complex and least understood parts of the FCC process is catalyst and feed contacting in the base of the riser reactor. In this region there is simultaneous transfer of heat, momentum, and mass. The incoming oil is from 300 to 1000 F. colder than the catalyst and experiences very rapid heating and vaporization. The oil vapor provides vertical momentum (lift) to accelerate the catalyst upward into the riser. Molecules in the vapor phase begin to diffuse into the catalyst pores where cracking occurs, and coke is deposited on the solids. These three transport processes begin essentially instantaneously when feed and catalyst meet, but are subsequently limited by how well the solids and the oil are mixed. When poor mixing occurs, heat transfer is reduced because the heat-carrying particles remain clumped together rather than distributed throughout the oil; momentum transfer is reduced because some regions of solids receive inadequate vapor flow and remain stagnant; and mass transfer is reduced because catalyst particles in large clusters are less accessible to oil vapor than isolated ones. Each reduced transport step carries a performance penalty. Poor heat transfer leads to delayed feed vaporization, which reduces conversion and can increase coke make. Poor momentum transfer leads to asymmetric and/or sporadic riser flow patterns, hence alternating regions of high and low cat-to-oil ratio which average to higher coke selectivity. Poor mass transfer leads to a higher contribution of thermal versus catalytic cracking, increasing selectivity to light gas.

Much effort has been spent developing better FCC feed nozzles and better ways to mix from 5 to 50 tons per minute of catalyst with smaller flows of oil feed in the base of a riser.

U.S. Pat. No. 5,108,583 is one of many FCC feed nozzle patents, and is incorporated herein by reference.

U.S. Pat. Nos. 4,717,467 and 4,578,183, which are incorporated by reference, modify the riser base to make better use of feed nozzles. A venturi section or draft tube promotes better contact of feed and hot catalyst.

Some refiners use a lift gas below the point of feed injection. This practice is based on the theory that catalyst will start smoothly up the riser, eliminating local currents and swirls of solids before the catalyst encounters the oil.

Another method involves using temperature scans above the feed nozzles to gauge the skew in the catalyst distribution and injecting the feed asymmetrically to produce a matching maldistribution. U.S. 4,808,383 has individually controlled feed nozzles in a riser reactor with a thermocouple probe to achieve matching oil and catalyst profiles and improve contacting.

These techniques—improved feed nozzles, different riser configurations, lift gas, asymmetric oil feeding—are all superior to conventional catalyst/oil mixing. None approach ideal mixing, and many create secondary problems. For example, high velocity nozzles enhance turbulence, but attrit catalyst. Skewed oil injection improves contacting, but reinforces overall maldistribution in the riser. Lift gas improves riser flow but increases the load on the wet gas compressor.

Despite more than 50 years of FCC practice, refiners still use unsophisticated hardware to contact heavy liquid feeds with hot catalyst and endure the resulting performance penalties. These penalties have become progressively more severe as increasingly heavy feeds, including resids, have been charged to FCCUs. Most FCC practitioners assume oil is instantaneously vaporized at the base of the riser. Among the minority who acknowledge a vaporization delay, most assume that the primary mechanism of vaporization is conductive heat exchange between hot catalyst and cold oil. Consequently these practitioners believe that adding the oil through high velocity nozzles is optimal because, besides increasing turbulent mixing, the high shear creates small liquid droplets and maximizes the area for heat transfer.

I wondered if catalyst/oil contacting has remained such a difficult problem because the conceptual model of the prevailing transport processes was incorrect. The conventional wisdom was that direct contact heat exchange between hot regenerated catalyst and oil feed was the primary heating and vaporization mechanism. I believed that radiation rather than conduction seemed the likely mechanism for heating (black) oil. At regeneration temperature FCC catalyst glows orange, and black oil should function efficiently as a block body to absorb radiant energy.

I became acutely aware of the catalyst/oil mixing problem while trying to use a pilot scale once-through riser to crack atmospheric resid feeds at short contact time. Conversion was much lower than expected and coke make was much higher, indicating poor feed vaporization. Poor mixing was manifested in a strong dependence of methane and butadiene yields (i.e. thermal cracking) on the catalyst/oil inlet temperature difference. Moreover, many runs had to be aborted after only minutes because the mixing section plugged up. Disassembly of the plugged section invariably revealed a dry paste of very heavy hydrocarbons and catalyst. Difficulty was also experienced in a larger, continuous recirculating FCC pilot plant when feeding resids. The unit typically shut down due to plugging and high riser pressure drop within 6 to 8 hours of starting a resid feed. These experiences made clear that feed vaporization at the base of the riser for heavy feeds was not only not instantaneous, it was not guaranteed to approach completion at all.

In response to these problems I embarked on an experimental program to develop an effective catalyst/oil mixing device. A total of six designs were tested, using room temperature catalyst and Freon-12 to represent vaporizing oil. The study revealed several critical facts about catalyst/oil mixing not evident in earlier studies which used a gas to simulate the oil. Indeed, the presence of vaporizing liquid completely changed the performance of the simpler mixers from that using gas/solids flow alone.

The means I developed to contact feed and oil in the base of a riser went 90 degrees, or perhaps 180 degrees, away from conventional teachings. Oil is injected at low rather than high velocity because high-velocity jets were found to cut straight through the upflowing solids and reach the riser walls, wetting the surface and allowing solids particles to stick. Catalyst is made to form eddies rather than exclusively straight lines because vaporization was found to be enhanced in regions of locally high solids density (and temperature). Oil is distributed from holes flush in a sloped surface rather than from nozzles because unvaporized liquid drops thereby flow away from one another until boiling occurs. In developing a mixer which would feed resids, I produced a device which would work better for all feeds, including distilled feeds such as gas oils, in any type of riser reactor.

The new mixing device was installed in the once-through riser pilot unit and completely eliminated plugging in the feed section. In addition, dry gas make was greatly reduced, coke yield was almost halved, and the yield of valuable liquid products increased. This indicated substantial enhancement of feed vaporization and mitigation of thermal cracking. The improvements were seen when cracking either light or heavy feeds. The device was then installed in the continuous recirculating pilot unit and completely eliminated feed section plugging in that unit as well.

Although unlike any previous catalyst/oil mixing device, my invention involves no more capital or operating expense than conventional hardware. It does not require unusual amounts of atomizing steam or lift gas, and reduces catalyst attrition because oil velocities are lower than in conventional nozzles. The device is also easily retrofit into existing FCC units, and disassembles readily for inspection and maintenance.

BRIEF SUMMARY OF THE INVENTION

Accordingly, the present invention provides a process for fluidized catalytic cracking (FCC) of a hydrocarbon feed containing liquid hydrocarbons boiling above 650° F. to catalytically cracked products comprising charging liquid hydrocarbons and regenerated catalyst from a catalyst regeneration means to a catalyst and feed mixing means comprising a vertical, cylindrical outer housing having a vertical centerline, a feed injector support means within said outer housing containing a plurality of radially distributed feed outlets, said feed injector support having a vertical centerline aligned with the vertical centerline of said outer housing, and wherein said outer housing and said feed injector support define an annular opening having a cross sectional area for fluid flow between said outer housing and said feed injector support, a catalyst inlet in a base portion of said outer housing for regenerated catalyst connective with said annular opening, and a liquid hydrocarbon feed inlet connective with said feed outlets; lifting catalyst up said annular opening into a deceleration zone within said mixing means characterized by an increased cross-sectional area available for fluid flow which results in the formation of a torus of circulating vortices of regenerated catalyst; injecting hydrocarbon feed liquid from said feed outlets into said torus and at least partially vaporizing said liquid within said torus to form a mixture of catalyst and at least partially vaporized feed; charging said mixture into a base portion of a riser reactor means; cracking said feed at cracking conditions in said reactor to produce cracked products and spent catalyst; separating cracked products from spent catalyst to produce a vapor phase containing cracked products which is recovered as a product and a solids-rich stream of spent cracking catalyst stripping conditions to produce a stripped catalyst phase containing coke; regenerating said stripped catalyst in a catalyst regeneration means at catalyst regeneration conditions including contact with an oxygen-containing gas to produce regenerated catalyst; and recycling said regenerated catalyst to said base portion of said catalyst and feed mixing means.

In an apparatus embodiment, the present invention provides an apparatus for mixing and vaporizing an at least partially liquid feed with fluidizable solids comprising a vertical, cylindrical outer housing having a vertical centerline; a feed injector support means within said outer housing containing a plurality of radially distributed feed outlets, said feed injector support having a vertical centerline aligned with said vertical centerline of said outer housing, and wherein said outer housing and said feed injector support define an annular opening having a cross-sectional area for fluid flow between said outer housing and said feed injector support; a catalyst inlet in a base portion of said feed injector support for regenerated catalyst connective with said annular opening; a liquid feed inlet connective with said feed outlets; a deceleration region above and connective with said annular lift region characterized by an increase in cross-sectional area available for fluid flow wherein are located said radially distributed feed outlets; a fluid connection between said deceleration region and a riser reactor means.

BRIEF DESCRIPTION OF DRAWINGS

FIG. *2a* (Prior Art) shows a cross section of a conventional FCC riser reactor. FIG. 21 shows an elevation view of the same riser reactor.

FIG. *3a* and *3b* (Invention show more details of the feed injection assembly. This design promotes radial inward-rotating vortex mixing.

Figure 4:
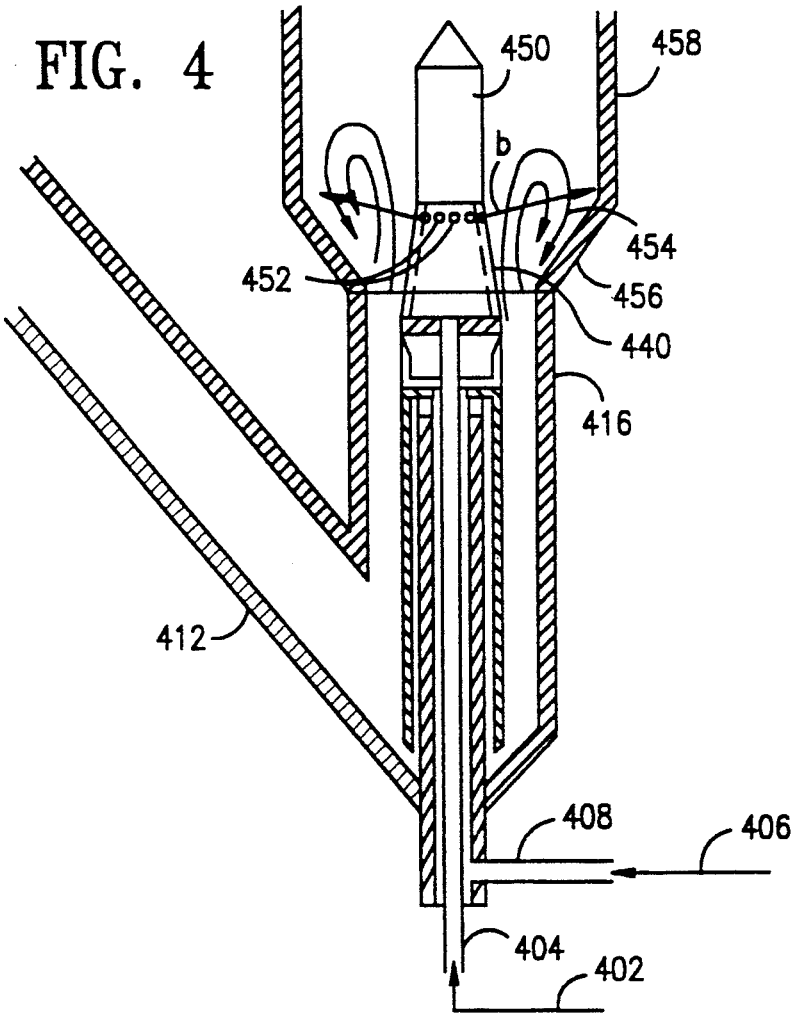

FIG. 4 (Invention) shows a single-stage mixer with radial outward-rotating vortex mixing suitable for use in a commercial riser reactor.

Figure 5:
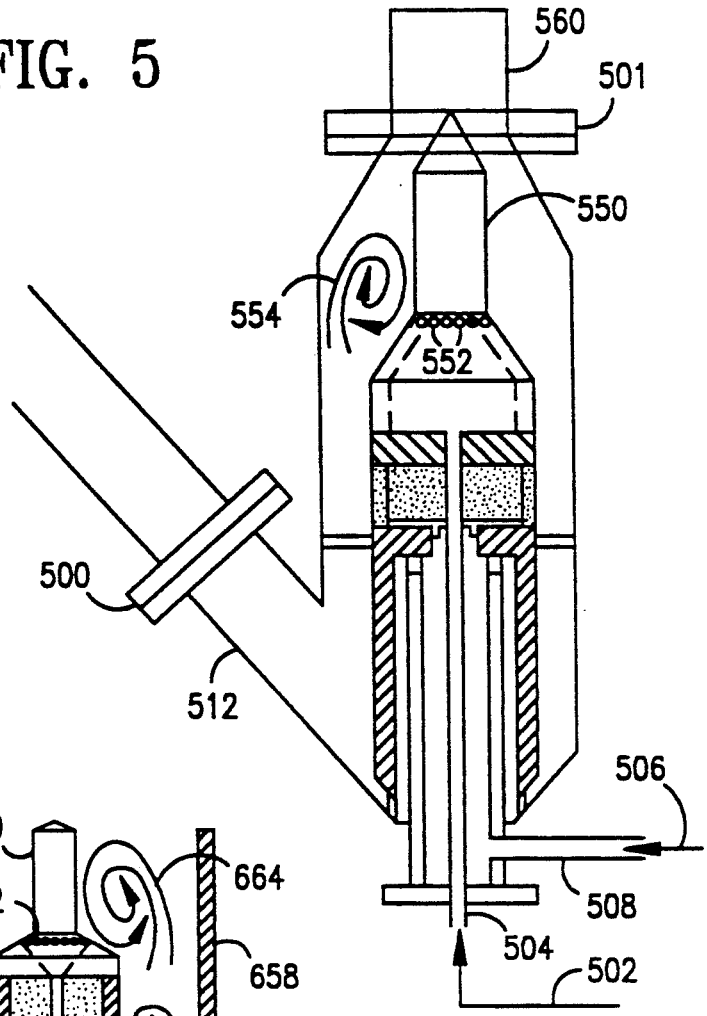

FIG. 5 (Invention) shows an inward-rotating vortex mixing device well suited for lift gas preheat or use in a pilot plant reactor.

Figure 6:
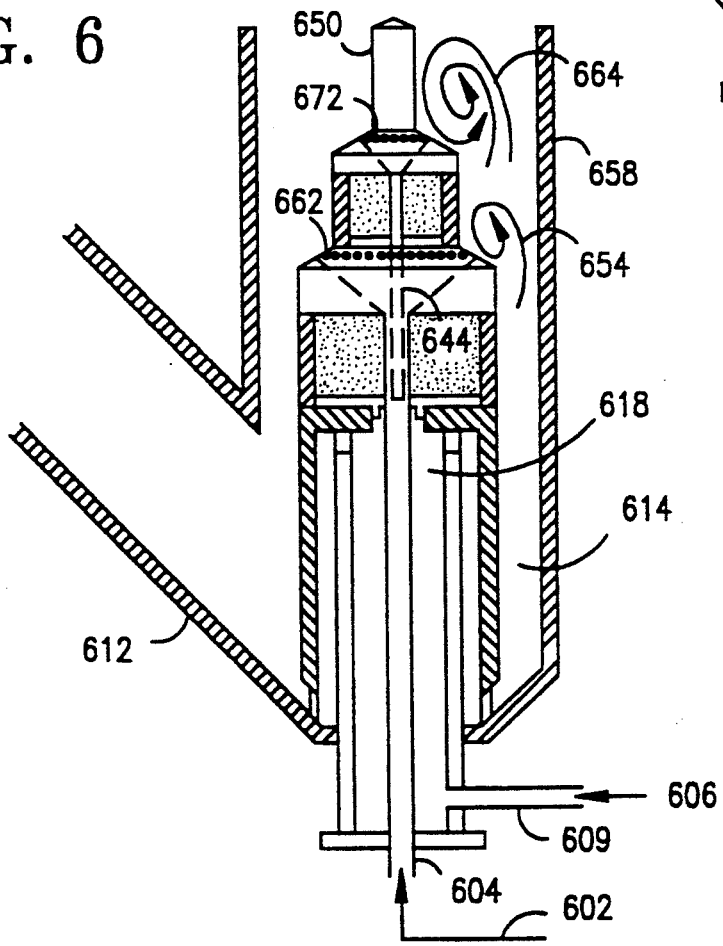

FIG. 6 (Invention) shows a two-stage mixing device.

Figure 7:
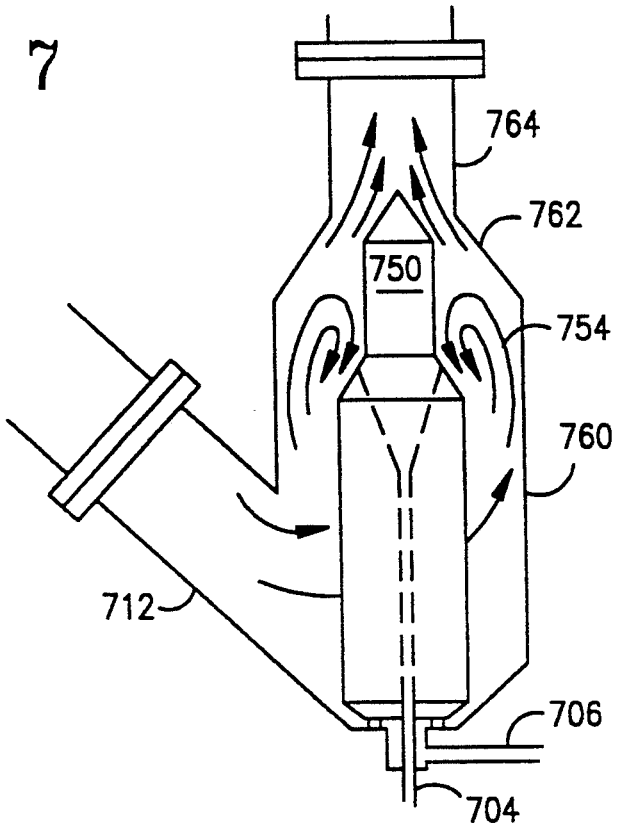

FIG. 7 (Invention) shows a mixing device with inward-rotating vortex mixing well suited for use in a commercial riser reactor.

Figure 8:
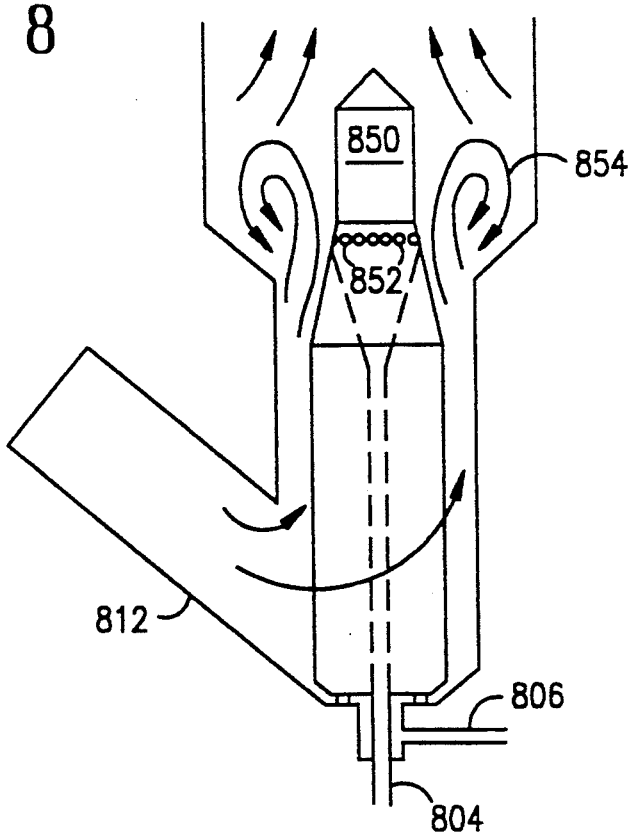

FIG. 8 (Invention) shows a mixing device with outward-rotating vortex mixing for use in a commercial riser reactor.

DETAILED DESCRIPTION OF PREFERRED EMBODIMENTS

Figure 2B:
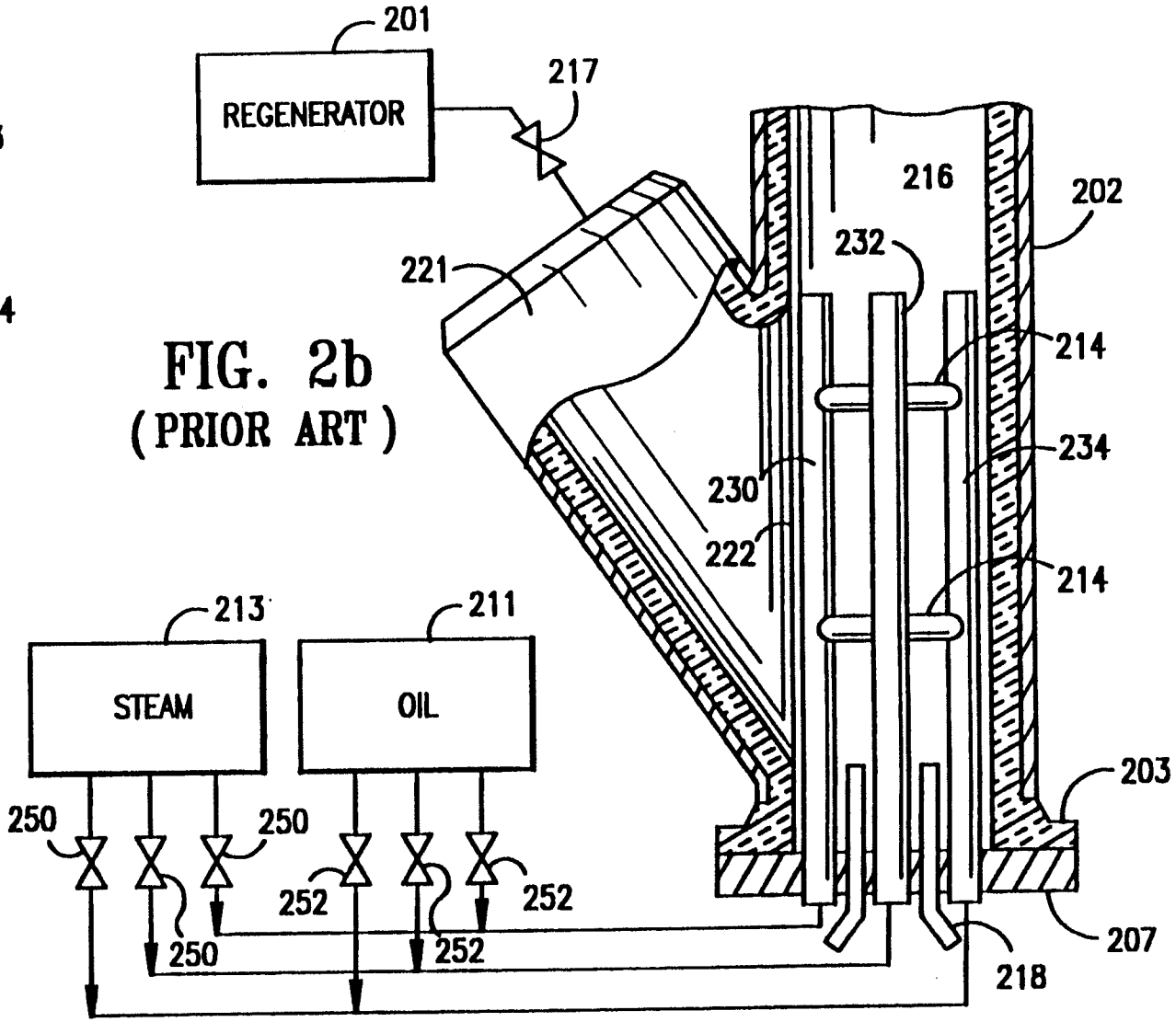
FIG. 2b (PRIOR ART)
Figure 2A:
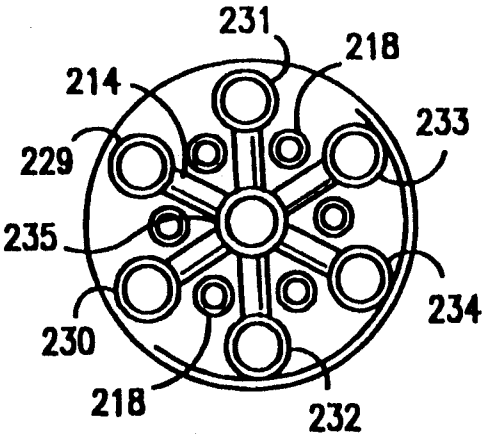
FIG. 2a (PRIOR ART)

Before discussing the feed mixing system of the present invention, it will be useful to review a conventional approach to feed mixing, the device shown in FIG. 2.

FIG. 2 (Prior Art) is taken from U.S. Pat. No. 4,808,383, Frank M. Buyan and Mark S. Ross, which is incorporated by reference.

FIG. *2b* shows a regenerator 201 discharging hot regenerated catalyst through slide valve 217 to the wye catalyst inlet 221. Catalyst flows through opening 222 and around a plurality of feed nozzle pipes 230, 232 and 234 and others not shown. Support members 214 strengthen the feed nozzle assembly, but no fluid flows through them. Steam from source 213 and oil from source 211 pass through steam valves 250 and oil flow control valves 252 to the bases of the feed nozzle pipes. Oil and steam are discharged upward into riser reactor 202, and oil contacts catalyst in region 216. Emergency steam nozzles 218 are provided at the base of the riser to provide a means to break up catalyst plugs which may form.

FIG. *2a* (Prior Art) is an elevation view, showing feed nozzle pipes 229, 230, 231, 232, 233, 234, and 235. Blast steam nozzles 218 are again shown, but are not used during normal operation.

Although there are many variations on this basic configuration, the prior art approach to mixing of feed and hot regenerated catalyst generally involves the same steps—starting the catalyst up the riser, spraying the oil up the riser, and assuming that the oil vaporizes and is catalytically cracked before leaving the riser. Upflow of catalyst, and generally co-current flow of catalyst and oil, are the standard. For enhanced mixing, refiners resort to higher nozzle velocities and/or higher lift gas flows. Some patents report use of so much lift gas that the catalyst is already dilute phase before it contacts the oil.

By contrast to the prior art, I use dense phase catalyst circulating in vortices at the feed nozzle outlets. Very low nozzle velocities are then needed because heat transfer is already enhanced by the turbulence and locally high density and temperature of the solids. Higher nozzle velocities can be used but are not optimal. The details of this catalyst/oil mixing technique can best be understood in conjunction with a review of FIG. 1, which, on A-4 paper, is approximately the same size as the actual device used in my pilot plant experiments.

Feed mixing nozzle 10 receives hot regenerated catalyst through line 12, oil feed 2 through oil inlet 4, and lift gas 6 through lift gas inlet 8. Any dispersion steam flows with the oil through oil inlet 4. Catalyst from line 12 enters the device in a manner similar to that in a commercial riser reactor, such as shown in FIG. *2b*. Catalyst flows around the base portion 46 of the nozzle into annular region 14. Lift gas 6 flows through the concentric annuli 18 of the mixing device first upwardly and then downwardly, exiting at the base into the bottom of region 14, then lifts and accelerates catalyst through acceleration region 16. The catalyst/lift gas mixture passes over positioning pins 80 into a region of enlarged cross-section containing a plurality of feed outlet holes 52. Vortices of catalyst 54 form due to the step increase in flow area, and contact oil and atomizing vapor exiting through the holes 52 from the internal chamber 70 of the oil distributor 40 fed by oil inlet line 4. Catalyst and oil then accelerate past vortex partitioner 50 through converging annular passageway 56 into tube 58 connecting with the base of the pilot plant riser reactor 60.

Several features of the device are intended to provide insulation between regions of different temperatures. Concentric annular passageways 18 form a dual layer of gas which insulates the oil line 4 from the regenerated catalyst temperature prevailing in the lift chamber 14, and serve to preheat the lift gas. Insulation of the oil line is critical to prevent thermal cracking (above about 700 F.) or coking in the line which would result in pluggage. Insulating ring 44, insulating insert 48, and centering disc 49 together prevent upward axial heat conduction from base section 46—typically at the regenerated catalyst temperature—to oil distributor 40—typically at the catalyst/oil mix temperature—through its baseplate 42. Insulating ring 44 is a durable rigid material with a lower thermal conductivity than metal, such as a ceramic, and provides a housing for a more porous, much less conductive insulating medium 48. In the prototype device insulating medium 48 was made of Marinite P (supplied by Pickwick Industries, Philadelphia, Pa.). Centering disc 49 is the only metallic element connecting the high-temperature base section 46 with the lower-temperature oil line 4, and is consequently of minimal thickness. A ceramic is also acceptable for this disc if its mechanical strength is high.

Figure 1:
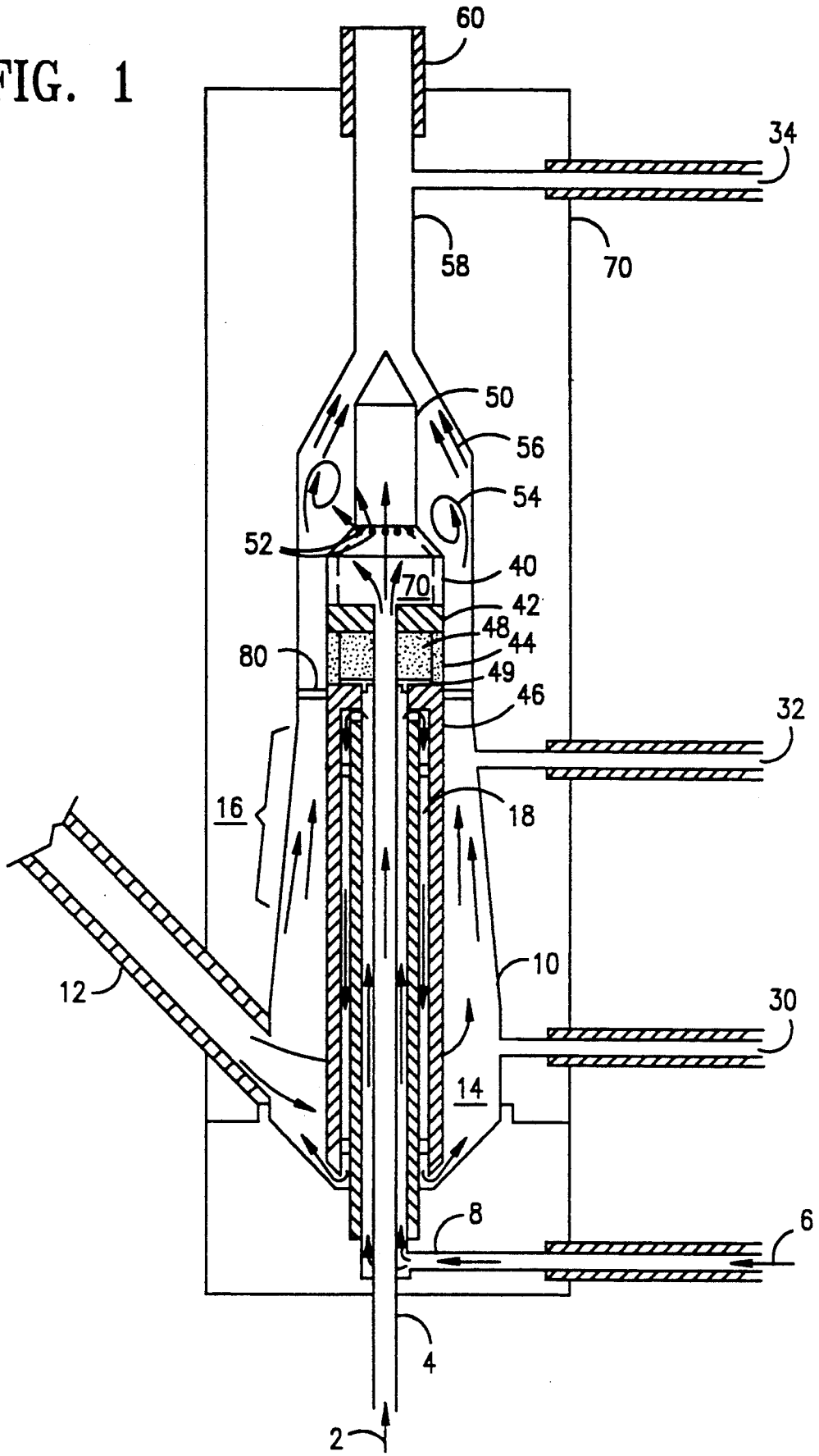
FIG. 1 (Invention) shows a preferred feed mixing device, especially suited for use in pilot plants, with a catalyst acceleration zone, a deceleration zone with feed nozzle bores, and a mixture acceleration zone.

The device as shown in FIG. 1 contains several features which are important for pilot plant use but optional for commercial-scale use. Thermowells 30, 32, and 34 are not essential in a production unit. Aligning pins 80 are not needed in a refinery FCCU as the structure is sufficiently rigid at the larger scale. Insulating elements in the smallscale mixer, specifically the concentric annular passageways for lift gas and the insulating assembly between the base section and oil distributor, may be omitted in a refinery device because commercial gas and solids flow rates are large compared to the mass of the equipment.

Figure 3A:
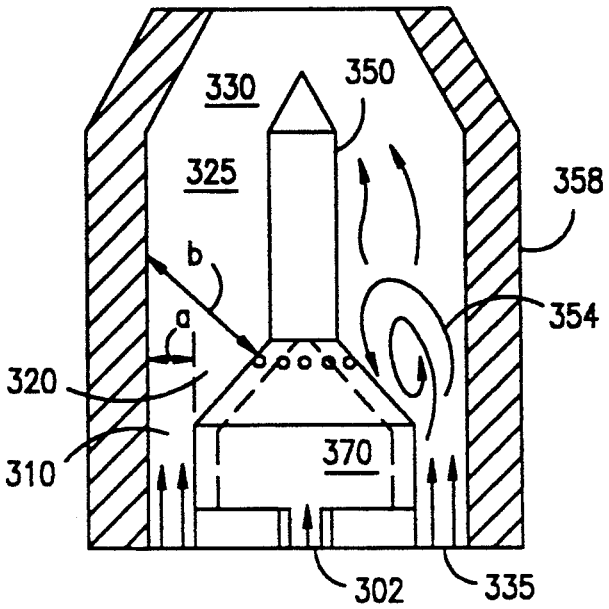
Figure 3B:
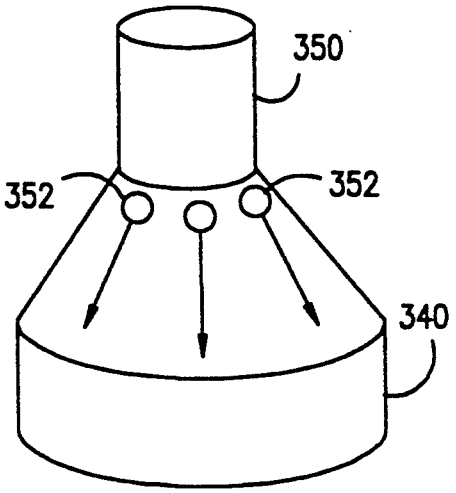

FIGS. 3*a* and 3*b* provide more details of the nozzle outlets and the dynamics of catalyst and oil flow in the feed mixing device of FIG. 1.

FIGS. 3*a* and 3*b* show an upflowing stream of catalyst 335 in the annulus surrounding oil distributor 340, and a flow of oil and atomizing steam 302 entering the inner chamber 370 of the oil distributor 340. Catalyst velocity is relatively high in annular region 310 but decreases suddenly upon entering region 320 where the diameter of the oil distributor 340 decreases. Vortices of gas-solids flow 354 consequently form in region 320. Oil and steam are discharged via outlet holes 352 at a modest velocity into the vortices 354. At this point cracking reactions begin, and all turbulence is subsequently enhanced by the volumetric expansion which results. The vortices collectively form an inwardly rotating torus, the consolidation of which is prevented by vortex partitioner 350 to preserve the turbulent small-scale mixing provided in the vortices. The first fractions of a second of cracking thereby occur in a series of vortex microreactors. Vortex partitioner 350 also serves to provide a restriction at the exit of the chamber which accelerates the catalyst/oil mixture and reestablishes straight lines of flow. The mixture then proceeds into the base of the riser where cracking reactions continue.

For high-boiling feeds it is anticipated that some unvaporized oil may persist from outlets 352 and flow down the conic surface of the distributor 340. Because the outlets 352 are mounted around a conic surface these oil streams will diverge, preventing coalescence and spreading the liquid out, which in turn increases radiant heat transfer. It is expected that all oil will vaporize before reaching the lower rim of the conic surface.

To minimize the chance of wetting the inner walls of the mixing section 320 (which would rapidly lead to plugging) it is preferred to discharge the oil at an angle 30 to 60 degrees above horizontal and most preferably about 45 degrees above horizontal as shown. Preferably the conic surface containing the outlet holes forms a 30 to 60 degree angle with the horizontal, and most preferably a 45 degree angle as shown. This means the distance b from an outlet hole to the wall will be several times greater than the width a of the annular region separating the wall 358 of the mixing device from the cylindrical base of the oil distributor 340.

FIG. 3 illustrates that mixing in the device departs from FCC commercial practice in two ways. First, the catalyst is purposefully spread out to meet the oil rather than the reverse. Second, the kinetic energy of the denser phase is used to effect mixing. This approach has the advantage that the energy already possessed by the solids is exploited rather than expending more energy into the oil to do the same job. Because of this the mixer has a very low oil-side pressure loss and is attractive for commercial applications where feed pressure drop is limiting.

FIG. 4 shows another version of the feed mixing device which is well suited for a pilot plant riser. Here the diameter of the oil distributor is essentially fixed while the diameter of the containment (which may be the base of the riser) is suddenly increased. This reverses the vortex rotation from the case shown in FIGS. 3*a* and 3*b*, inducing an outwardly rotating torus. Hot regenerated catalyst is discharged via catalyst inlet 412 into the base of the feed mixing device. Lift gas 406 is added via lift gas inlet 408, as in the FIG. 1 embodiment, to lift catalyst up through annular section 416. The enlarged section 456 causes vortices 454 to form near outlet holes 452 of oil distributor 440. Vortex partitioner 450 prevents convergence or dissipation of the annular ring of vortices. A mixture of feed and oil thus passes up region 458, which is typically the base of the riser reactor. Preferably there is at least a small reduction in diameter of the oil distributor 440 at the point of the outlets 452 as shown. The distributor may be a constant-diameter cylinder or even expand slightly outward, but the advantage of separating any unvaporized liquid streams on the surface of the distributor is lost when the diameter reduction is not present. Regardless of the shape of oil distributor 440 the outlet holes 452 must discharge oil at an angle somewhat above horizontal as needed to direct the flow toward the widest portion of the walls 458 forming the base of the riser reactor.

FIG. 5 shows a simplified view of the mixing device fitted with flanges for installation in a refinery FCCU or large pilot plant. Flanges 500 connect the regenerated catalyst inlet 512 to the regenerator (not shown) while flanges 501 connect the mixing assembly to the base of the riser reactor 560. Oil and dispersion steam 502 are charged via oil inlet 504, while lift gas 506 enters through lift gas inlet 508. Vortices 554 form a torus of swirling catalyst about feed nozzle outlets 552 which remains centered around vortex partitioner 550. Other elements of the base section, including the use of lift gas as an insulating medium for the oil line, as identical to those depicted in FIG. 1.

FIG. 6 shows a two-stage feed mixing device. Catalyst enters via line 612, while oil and dispersion gas 602 pass up inlet 604. Lift gas 606 passes through concentric annular passageways 618 and exits into lift chamber 614 to lift catalyst as a annular ring about the feed nozzle base. Vortices 654 form about the first tier outlet holes 662 which discharge a portion of the oil and dispersion gas. A second set of vortices 664 forms about second tier outlet holes 672 which discharge the remaining portion of feed and dispersion gas carried via tub 644 to outlets 672. The length of tube 644 is chosen to equalize the pressure drop between the two tiers of outlet holes, thereby dividing the feed roughly equally between them. Alternatively, tube 644 extends to the base of the device and through a separate flange or sealing gland (not shown) concentric with that of line 604, permitting two entirely different feed streams to be introduced at the two tiers of holes. Vortex partitioner 650 prevents vortex convergence following the second mixing stage, while the second tier oil distributor itself acts to prevent vortex convergence following the first mixing stage.

FIG. 7 shows a flanged feed mixing assembly well suited for refinery use. Catalyst enters the device via line 712 and forms an annular flow around the feed mixing assembly. Lift gas is added via line 706 to the base of the mixing device, but may also enter through means (not shown) either upstream or downstream of the catalyst slide valve, or through steam blast nozzles (not shown) mounted in the base of the assembly. Catalyst flows upward within lift chamber 760 and forms vortices 754 into which oil and dispersion steam are injected through outlet holes (not shown). Vortex partitioner 750 acts to preserve the inwardly rotating torus of catalyst/oil flow. The mixture of catalyst and feed is accelerated through section 762 by the reduction in cross sectional area and discharges into the base of the riser reactor 764. No insulating gas passageways are needed or provided in the base section of the mixer because the oil flow is sufficiently large that significant heating cannot occur during the very short residence time in the oil feed line. Most conventional FCCUs operate with feed nozzle pipes extending into the base of the riser with no special insulation other than that afforded by the refractory added for erosion protection.

FIG. 8 shows a similar commercial-type nozzle, but with outwardly rotating vortex formation. Catalyst enters through line 812, oil flow through line 804, and lift gas through line 806. Vortices 854 form due to the enlarged diameter at the point of discharge of outlet holes 852 which represents the base of the riser reactor. Vortex mixing is prolonged by vortex partitioner 850, whereafter the catalyst/oil mixture proceeds up the riser.

Following this overview of the process and apparatus of the invention, details will now be provided about the FCC process and various features of the feed mixing section.

FCC FEED

Any conventional FCC feed can be used. The process of the present invention is especially useful for processing stocks containing large amounts of non-distillable materials, e.g., 3 wt % or greater Conradson Carbon Residue (CCR).

The feeds may range from the typical, such as petroleum distillates or residual stocks, either virgin or partially refined, to the atypical, such as coal oils and shale oils. The feed will frequently contain recycled hydrocarbons, such as light and heavy cycle oils which have been previously cracked.

Preferred feeds are gas oils, vacuum gas oils, atmospheric resids, and vacuum resids. The invention is most useful for feeds having an initial boiling point above about 650 F.

FCC CATALYST

Commercially available FCC catalysts may be used. The catalyst must contain relatively high amounts of large pore zeolite for maximum effectiveness, but such catalysts are readily available.

Preferred catalysts for use herein will usually contain at least 10 wt % large pore zeolite in a porous refractory matrix such as silica-alumina, clay, or the like. The zeolite content is preferably much higher than this, and should usually be at least 20 wt % large pore zeolite. For optimum results, the catalyst should contain from 30 to 60 wt % large pore zeolite.

All zeolite contents discussed herein refer to the zeolite content of the makeup catalyst rather than that of the equilibrium catalyst (E-cat). Much crystallinity is lost during the average of several months that a catalyst particle spends in the high-temperature steam environment of a modern FCC regenerator, hence the E-cat will contain a much lower zeolite content than the makeup as measured by classical methods. Most refiners characterize makeup catalyst by zeolite content but describe the E-cat in terms of overall cracking activity, using MAT (Modified Activity Test) or FAI (Fluidized Activity Index).

The large pore cracking catalyst may be a conventional zeolite such as X and Y, or an aluminum deficient form such as dealuminized Y (DEAL Y), ultrastable Y (USY) or ultrahydrophobic Y (UHP Y). The zeolites may be stabilized with rare earth metals, for instance 0.1 to 10 wt % rare earth.

Relatively high silica zeolitic catalysts are preferred for use in the present invention because they withstand the high temperatures of the FCC regenerator. Catalysts containing 30 to 60% USY or rare earth USY (REUSY) are especially preferred.

The catalyst inventory may also contain one or more additives, present either as a component of each particle of cracking catalyst or as an entirely separate particulate solid.

Possible additives include CO promoters, SOx capture agents, and octane enhancers (medium-pore or shape-selective zeolites, such as ZSM-5 and others having a Constraint Index of 1–12). The FCC catalyst composition, per se. forms no part of the invention.

FCC REACTOR CONDITIONS

Conventional riser cracking conditions may be used, but significant increases in conversion or severity are possible using the feed mixing process of the invention.

Typical riser cracking conditions include catalyst/oil weight ratios of 1:1 to 10:1, and a catalyst residence time of 3 to 15 seconds. Most risers operate with an outlet or "top" temperature of 950° to 1050° F.

Preferably the cat-to-oil ratios and riser top temperature in my process are higher than those used in conventional riser cracking, and the catalyst and hydrocarbon residence times shorter. I prefer to operate with cat-to-oil ratios from 4:1 to about 15:1 to 20:1 cat:oil, and most preferably the higher ratios. Catalyst residence times should be less than 5 seconds and are preferably 0.5 to 4 seconds. The reactor outlet temperature is preferably above 1000° F., most preferably from 1025° to 1100° F., preferably about 1075° F.

Although conventional operatinq conditions can be used, I prefer more severe operation to take advantage of the reduced coke make, decreased dry gas yield, and higher conversion achieved with the new feed mixing section.

REACTOR OUTLET & SEPARATION

It is preferred, but not essential, to rapidly separate spent catalyst from cracked products discharged from the riser reactor. Use of a cyclone separator, or other inertial separator will help separate coked catalyst from product vapors.

CATALYST STRIPPING

Conventional stripping techniques can be used to remove strippable hydrocarbons from spent catalyst. These usually involve contacting the solids with 1 to 5 wt % steam in a bubbling fluidized bed.

CATALYST REGENERATION

The process and apparatus of the present invention can use conventional FCC regenerators. Most FCCUs feature a single large vessel with a dense-phase bubbling fluidized bed of catalyst. High efficiency regenerators with a fast fluid-bed coke combustor discharging into a dilute-phase riser, and a second fluidized bed to collect regenerated catalyst, may also be used. Several representative bubbling dense bed regenerators are noted below.

Swirl regenerators are disclosed in U.S. Pat. No. 4,490,241, Chou, U.S. Pat. No. 4,994,424, Leib and Sapre, incorporated by reference.

A cross-flow regenerator is disclosed in U.S. Pat. No. 4,980,048, Leib and Sapre, incorporated by reference.

A regenerator associated with a stacked or Ortho-flow type FCC unit is disclosed in U.S. Pat. No. 5,032,252 and U.S. Pat. No. 5,043,055, Owen and Schipper, incorporated by reference.

FEED MIXING SECTION

There are several different regions of the feed mixing section of the present invention, which can be described either in terms of apparatus or function. Some of the regions are preferred but not essential. The sections are listed below and then reviewed in depth.

1. Catalyst Entry (into the mixer)
2. Catalyst Vortex Formation
3. Cross-Flow Oil Injection
4. Catalyst/Oil Acceleration (into the riser)

Catalyst Entry

The catalyst must enter the base of the mixing zone with a moderate amount of kinetic energy, which is typically available as a result of the transit from the regenerator. The catalyst should be lifted, or preferably gradually accelerated, into the relatively narrow annular region defining the catalyst inlet to the mixing section. The minimum superficial gas velocity in the annular region will be that required for catalyst fluidization (Umf). The superficial velocity in this region will usually be from 100 to about 300% of Umf, preferably from 125 to 250% of Umf, and most preferably from about 150 to 200% of Umf.

In most commercial units this will translate into a minimum superficial velocity of at least 0.1 fps, preferably above 0.1 to 0.15 fps, and most preferably from 0.15 to 0.20 fps. Superficial velocities much above this are not desired because the excess lift gas involved will dilute the vortices formed at the oil injection points. Excessive lift gas velocities can also result in erosion of the outlet holes and/or the vortex partitioner.

The specified catalyst velocities are not particularly high for FCC units, and are readily achieved by adding lift gas, steam, or light hydrocarbon streams to the base of the riser. I prefer to use a relatively clean lift gas from the unsaturated gas plant.

Catalyst Vortex Formation

The essential feature of the device is a region of local catalyst deceleration and vortex formation induced by a marked increase in available flow area. The resulting vortices of catalyst are denser than the approaching gas/solids flow, that is, the number of solid particles per unit volume is greater. As such the vortices represent miniature mixing cells with significant internal turbulence. It is this naturally concentrated mixing energy which is exploited in the present device to effect rapid dispersion of the feed oil.

Vortex formation in a closed conduit occurs when the flow encounters a change in confinement geometry so sharp that the turbulent boundary layer cannot conform to it. In a sudden expansion, for example, the boundary layer detaches from the wall because it cannot spontaneously widen to fill the greater cross-sectional area. Over the short distance required for the mainstream flow to re-attach to the wall, the incremental volume is occupied by comparatively stagnant fluid which, being in viscous contact with the main flow, continuously rotates. These stationary vortices are highly turbulent but remain fixed in the conduit, continually exchanging fluid with the mainstream flow. In other flow configurations the vortices formed by geometric features are periodically shed into the downstream flow as small packets of rotating fluid. The von Karman vortex street, well-known among practitioners of fluid mechanics, consists of two parallel rows of regularly spaced vortices which form in flow normal to a cylinder. Such periodic shedding phenomena occur behind unstreamlined objects, including those of circular cross-section, because lateral fluctuations on the downstream surface cause the point of boundary layer detachment to oscillate from side to side.

Vortex formation in the subject mixing device may be achieved in one of two ways. The outer housing may be of constant diameter with the feed injector means having a sudden reduction in outer diameter, or the feed injector may have a constant outer diameter while the outer housing has a sudden increase in inner diameter. Either approach provides a deceleration region which promotes vortex formation.

If a cylindrical outer housing of constant diameter is contemplated, the increase in flow area is realized using a vertical cylindrical feed injection assembly, concentric with the outer housing, having a large diameter base and reduced diameter approaching the outlet holes. Vortices will initiate just past the diameter reduction and fully occupy the volume surrounding the outlet holes. Within each vortex catalyst will flow upward and inward somewhat away from the outlet holes, and downward and outward just at the holes. To an observer in an outlet hole catalyst would appear to flow downward just outside the hole but upward in the distance, and no significant horizontal flow would be observed. The other approach is to use a constant diameter feed injection assembly centrally mounted in an outer housing which is flared approaching the feed outlet holes. Vortices will then form in which catalyst flows upward and outward near the outlet holes, then downward and inward somewhat away from the holes. An observer in an outlet hole would see upward catalyst flow just outside the hole up and downward flow some distance away, again with no transverse component.

If a transparent flow model is used to design a mixing device of this type it should be verified that the shape of the flow chamber approaching the outlet holes produces vortex formation under all anticipated flow rate variations. (At very low vapor rates, for example, the flow may be laminar and vortices will not form). Towards this end it is critical when simulating the flow to account for feed vaporization effects, if applicable.

In terms of superficial vapor velocity (or cross-sectional area for flow) the following guidelines may be given. Superficial vapor velocity—based on lift gas only—should be no more than minimum fluidization velocity (Umf), preferably from 50 to 95% of Umf, more preferably from 65 to 85% of Umf, and most preferably from 70 to 75% of Umf. Superficial vapor velocity in the mixing region—based on oil plus dispersion steam/vapor plus lift gas—should be at least 2 Umf, preferably at least 3 Umf, more preferably at least 4 Umf, and most preferably 5 or more times Umf. I prefer to operate with velocities from 5 to 50 times Umf.

Fluidizing velocities are easy to recite but difficult to determine in actual use. FCC feed contains mostly distillable materials which vaporize at various rates and begin cracking (and hence expanding) immediately upon exposure to regenerated catalyst. It is thus difficult to assess the vapor traffic in the region of the mixer where specifications are needed. In light of these difficulties, guidance on optimizing the design can be given in terms of physical geometry.

The ratio of the cross-sectional flow area between the deceleration region and the annular lift region is preferably between 1.5 and 2. Thus the ratio of flow area at the elevation of the feed outlet holes to that in the approaching annular lift section should be at least 1.5:1, preferably at least 1.75:1 and most preferably between 1.75:1 and 2:1. Expansion surface area ratios greater than 2:1 may result in secondary vortices.

Preferably the transition from the annular lift section to the feed outlet section is formed with one straight side and one side bending inward or outward at least 30 degrees from the vertical, preferably at least 40 degrees from the vertical, and most preferably between 40 degrees from the vertical and the angle of repose of the solids measured from the horizontal. In vertical be so large that the angle formed with the horizontal is less than the angle of repose of the catalyst, as regions of stagnant solids may collect on the step thus formed.

Preferably the ratio of the outer diameter of the feed injector support means to the inner diameter of the outer housing in the annular lift region is between 0.20 and 0.95, and the ratio of the outer diameter of the feed injector support means to the inner diameter of the outer housing in the deceleration region is between 0.05 and 0.50. The acceleration region should have a cross-sectional area for flow less than that of the deceleration region, and preferably the ratio of cross-sectional area for flow between the deceleration region and the acceleration region is between 2:1 and 50:1.

The vortex mixing section works best when the ring of vortices formed at the area expansion is prevented from converging to the centerline of the mixing device, thereby maintaining a greater volume of high solids density. This is achieved mechanically by a solid cylindrical plug or vortex partitioner, preferably refractory lined, contiguous with the outlet holes and extending downstream (i.e. upward) therefrom. The vortex partitioner preferably extends up the mixing body by an amount equal to at least the vertical dimension of the vortices. However, the vortices are in general elliptical with an eccentricity which varies with flow rate through the device. More specifically, the vortex width is always approximately the difference between the larger and smaller radii defining the expansion in the feed injection chamber, but the length increases as the approach velocity increases. It is therefore more practical to size the vortex partitioner for a maximum vortex eccentricity.

Preferably the vortex partitioner is a cylindrical vertical extension aligned with the vertical centerline of the outer housing. Ideally the acceleration zone is an annulus having an outer diameter defined by the outer housing and an inner diameter defined by this type of vortex partitioner. The vortex partitioner preferably extends a distance downstream of the outlet holes equal to 4 times the difference of the larger and smaller radii defining the expansion. The vortex partitioner preferably has a length to diameter ratio of at least 2:1. The extreme tip of the vortex partitioner is preferably conically shaped to prevent secondary vortex formation at or around it, thus the cylindrical vertical extension preferably terminates in a right circular cone.

I prefer to use a single mixing stage, but it is possible to use two or more mixing stages if desired. Different geometries may be used at the stages of a single mixer, such as a first stage with a constant diameter outer housing and reduced diameter feed injection assembly, followed by a second stage with a fixed diameter injection assembly and a flared outer housing.

Cross-Flow Oil Injection

The feed mixing section of the invention, in which feed is injected directly into vortices, tolerates myriad means of feed introduction. The mode of injection is not nearly as critical as the locus of injection: the kinetic energy in the vortices, and the much greater mass of catalyst relative to feed—typically 5:1 to 10:1—ensures rapid and effective mixing of fluid and solids even if the oil is minimally dispersed on entry. Analogously, the fastest way to disperse a substance from a fixed point into the earth's atmosphere would be to release it into a hurricane. On Jupiter, one would release the material into the Great Red Spot.

Performance of the device is enhanced using atomizing means at the feed outlets provided these do not lead to excessive oil velocities entering the mixing chamber. A small amount of dispersion steam, nitrogen, or other gas is preferred for achieving droplet breakup. Unlike conventional FCC nozzles the feed outlets should be flush, or almost flush, with the walls of the centrally located feed injection assembly. Preferably the nozzle outlets protrude into the vortex region by an amount less than 0.1 times the OD of the injection assembly at the elevation of the feed outlets. More preferably the nozzle protrusion is less than 0.05 times the shorter axis of typical vortices as calculated or observed in transparent test equipment.

Whether nozzles or simple holes, the feed injection means are preferably located just below the upper boundary of the conic face of the feed injection assembly. The feed injection means are oriented preferably normal to the conic face and in no case at an angle with the horizontal less than that corresponding to this normal. An angle greater than that corresponding to normal with the conic face is desirable only if it substantially increases the distance from the feed outlets to the outer wall of the mixing section. In the preferred embodiment the feed injection assembly and outer wall are shaped and disposed relative to each other such that injection normal to the conic face results in a relatively long traverse to the outer wall.

The following guidelines can be given regarding minimum, maximum, and preferred oil inlet velocities. The inlet velocities assume oil is fully vaporized and accompanied by about 2 wt % dispersion steam.

There is no minimum oil inlet velocity. The device tolerates some wetting of the conic face without plugging, indicating that dribbling or weeping flow from the outlet holes is sufficient. I prefer to minimize wetting of any surface and reserve this robustness of the device for occasional pulses of low catalyst density. I would therefore choose an oil inlet velocity at least as high as the minimum fluidization velocity of the catalyst, preferably at least twice this, and more preferably at least ten times minimum fluidization velocity.

The maximum oil inlet velocity depends to some extent on the internal geometry of the feed mixing section. In general the inlet velocity should be low enough that the inner walls of the mixing section (which may correspond to the walls of the riser base) are not wetted by oil during either normal operation or upsets. If the distance from the feed outlet holes to the wall is large, and/or if the catalyst vortices are large and maintain a high solids density, then relatively high oil inlet velocities may be tolerated. In most cases good results will be achieved with oil inlet velocities ranging from 1 to 50 fps, preferably 2 to 40 fps, more preferably 5 to 30 fps, and most preferably 10 to 25 fps.

A typical refinery FCC charge is 10 vol % vaporized at the preheater temperature and is fed with 2 wt % dispersion steam. For this case oil inlet velocities are preferably 1 to 10 fps, more preferably 3 to 7 fps, and most preferably 3.5 to 6 fps.

The quoted velocities are extraordinarily low compared to those of modern riser reactors. In commercial FCCUs the nozzle discharge velocities may reach 75 to 150 fps or more and always exceed the superficial vapor velocity in the riser which is itself typically 20 to 60 fps. These velocities are designed on the premise that the oil must add energy to the catalyst. In my process, by contrast, the catalyst is arranged into energetic vortices and imparts energy to the oil. My feed injectors need only get the oil into the turbulent catalyst vortices, whereupon the heat and mass of the catalyst take over the work of vaporizing and dispersing the oil droplets (which can be quite large). Sonic or high velocities are not needed to ensure good feed mixing; however the device of the present invention can work even when such nozzles are used provided wetting of the walls is avoided.

The oil, typically with 1 to 5 wt % dispersion steam, is preferably discharged perpendicular to catalyst flow at the point of injection. Some cocurrent and/or countercurrent injection is tolerable but the maximum mixing intensity occurs when oil is directed at the cores of the catalyst vortices. This will generally be achieved if the oil outlet holes (or atomizers) are oriented normal to the conic section of the feed injection assembly as noted previously. Preferably the oil is discharged from each point as a diverging cone rather than a solid rope. A flat fan spray is also effective if the spray from each point spreads horizontally rather than vertically.

A plurality of feed outlets are used, preferably 3 or more and more preferably 6 or more. The outlet holes or atomizers are preferably uniformly spaced about a cylindrical, vertical, centrally mounted support means axially aligned with the centerline of the riser reactor. The injector support means preferably comprises a truncated conical portion with the feed outlets mounted near the upper boundary thereof. At the elevation of the feed outlets the horizontal distance from the outlets to the wall of the mixing section is 50 to 90 % of the inner radius of the chamber at that elevation. However, the outlets preferably direct oil flow perpendicular to the conic face and transverse to catalyst flow at the entry points, hence the distance to the wall along the axis of feed injection is significantly longer.

Preferably the injector support means includes a reduced diameter vortex partitioning means axially aligned with the centerline of the riser and the injector support means. The vortex partitioner is mounted above the truncated conic section of the injector support means and has a diameter of 0.20 to 0.75 times the base (larger) diameter of the truncated conic section. The height of the vortex partitioner was specified previously. The partitioner prevents vortices from converging at the centerline of the mixing chamber, and confines the vortices more effectively to the region surrounding the feed outlets. This ensures that the maximum mass of catalyst, at the highest density, will traverse the feed outlets.

Catalyst/Oil Acceleration

Preferably the mixture of feed and catalyst formed in the mixing chamber is accelerated further entering the riser reactor. Higher velocities preserve the turbulent mixing and heat transfer initiated in the catalyst vortices, which helps to maximize vaporization of large droplets of distillable feeds or small droplets containing significant non-distillables.

Acceleration requires a reduction in flow area at the mixing section outlet, molar expansion of the vapor, or addition of more lift gas or dispersion steam. The latter is inconvenient, and although some molar expansion begins (with cracking) at the instant of catalyst/oil contact, it is preferred to decrease the diameter of the device somewhat near the outlet. This is readily achieved using the downstream tip of the vortex partitioner to define an annular opening with reduced flow area relative to the mixing section. In passing through this restriction the catalyst/oil mixture experiences acceleration and additional turbulent mixing. Although preferred, this feature is not essential, and the mixing section may simply connect into a riser of equal or similar diameter. However, if the riser has a larger diameter than the feed mixing means, velocity and turbulent mixing will be reduced and unwanted secondary vortices will form at the point of expansion.

In pilot plant installations it may be beneficial to allow significant indirect heat exchange between incoming feed (and/or lift gas) and hotter regenerated catalyst. Such preheating improves the flow properties of the feed and generates vapor which reduces the dispersion steam requirement. In commercial applications the feed injection assembly—particularly the lower portions thereof—may be sufficiently thick to provide adequate insulation against high temperatures and coking in the internal feed line. Where indirect heat exchange is desired, feed and/or lift gas and/or dispersion steam may be passed through tubes or passageways mounted in or on the walls of the injector support means.

It is helpful in pilot plant operation to house the feed outlets in a section of the feed injector support means which is thermally insulated from the base portion of the feed injector. In many pilot plant units it will be helpful to thermally insulate the connection from the feed inlet to the feed outlets from the outer wall of the base portion of the feed injector support means. This can be done with cooling gas in a labyrinth passageway as discussed above or with a an insulating packing, vacuum shell, or similar means. Insulating is easiest to achieve when a tubular conduit located at the centerline of the feed injector support is used to move feed from the feed inlet to the feed outlets.

I claim:

1. A process for fluidized catalytic cracking (FCC) of a hydrocarbon feed containing liquid hydrocarbons boiling above 650° F. to catalytically cracked products comprising:

a) charging liquid hydrocarbons and regenerated catalyst from a catalyst regeneration means to a catalyst and feed mixing means comprising:

a vertical, cylindrical outer housing having a vertical centerline;

a feed injector support means within said outer housing containing a plurality of radially distributed feed outlets, said feed injector support having a vertical centerline aligned with the vertical centerline of said outer housing, and wherein said outer housing and said feed injector support define an annular opening having a cross sectional area for fluid flow between said outer housing and said feed injector support;

a catalyst inlet in a base portion of said outer housing for regenerated catalyst connective with said annular opening; and a liquid hydrocarbon feed inlet connective with said feed outlets;

b) lifting catalyst up said annular opening into a deceleration zone within said mixing means characterized by an increased cross-sectional area available for fluid flow which results in the formation of a torus of circulating vortices of regenerated catalyst;

c) injecting hydrocarbon feed liquid from said feed ( outlets into said torus and at least partially vaporizing said liquid within said torus to form a mixture of catalyst and at least partially vaporized feed;

d) charging said mixture into a base portion of a riser reactor means;

e) cracking said feed at cracking conditions in said reactor to produce cracked products and spent catalyst;

f) separating cracked products from spent catalyst to produce a vapor phase containing cracked products which is recovered as a product and a solids-rich stream of spent cracking catalyst containing coke and strippable hydrocarbons;

g) stripping said spent catalyst in a stripping means operating at catalyst stripping conditions to produce a stripped catalyst phase containing coke;

h) regenerating said stripped catalyst in a catalyst regeneration means at catalyst regeneration conditions including contact with an oxygen-containing gas to produce regenerated catalyst; and i) recycling said regenerated catalyst to said base portion of said catalyst and feed mixing means.

2. The process of claim 1 wherein the superficial gas velocity in said annular lift section in said base portion of said mixing means is from 0.05 to 0.20 fps.

3. The process of claim 1 wherein the average superficial vapor velocity in said deceleration zone of said mixing means is 0.1 to 5 fps.

4. The process of claim 1 wherein said liquid feed is injected perpendicular to a circle forming the centerline of the torus of catalyst vortices.

5. The process of claim 1 wherein said liquid feed is injected from said feed injector support means via a plurality of radially distributed feed outlets within said deceleration zone.

6. The process of claim 5 wherein said feed outlets are circular holes flush-mounted on a truncated conic surface directing a spray of liquid feed at an angle of from 30 to 60 degrees above horizontal.

7. The process of claim 5 wherein said feed outlets are circular holes flush-mounted on a truncated conic surface directing a spray of liquid feed at an angle of 45 degrees above horizontal.

8. The process of claim 1 wherein said outer housing is of constant inner diameter and said deceleration zone is formed by a sudden reduction in the outer diameter of said feed injector support means.

9. The process of claim 1 wherein said feed injector support means is of constant outer diameter and said deceleration zone is formed by a sudden increase in the inner diameter of said outer housing.

10. The process of claim 1 wherein said torus of circulating vortices is formed about a vertical cylindrical plug having a vertical centerline aligned with said vertical centerline of said feed injector support means and contiguous therewith, having sufficient height to prevent closure of said torus upon said vertical centerline of said outer housing.

11. The process of claim 1 wherein said catalyst and feed mixture is accelerated between said deceleration zone and said riser reactor means by passing through a region having a cross-sectional area for flow less than that of said deceleration zone.

12. The process of claim 11 wherein said region of reduced cross-sectional area for flow is formed by a reduction in diameter of said outer housing.

13. The process of claim 12 wherein said region of reduced cross-sectional area for flow is an annulus having an outer diameter defined by said outer housing and an inner diameter defined by a cylindrical vertical extension of said feed injector support means having a vertical centerline aligned with said vertical centerline of said outer housing.

14. The process of claim 13 wherein said cylindrical vertical extension terminates in a right circular cone.

15. The process of claim 1 wherein said liquid hydrocarbon feed inlet is a vertical tubular conduit located at the vertical centerline of said feed injector support means.

16. The process of claim 15 wherein said tubular conduit is thermally insulated from the outer wall of said feed injector support means in said annular lift section by an intervening annulus of flowing gas.

17. The process of claim 16 wherein said intervening annulus contains an inner annular chamber through which gas flows upward surrounded by and connective with an outer annular chamber through which gas flows downward, both annular chambers having vertical centerlines aligned with said vertical centerline of said outer housing, said outer annular chamber being connective with said annular lift section at said base portion of said feed injector support means.

18. The process of claim 17 wherein said insulating gas is lift gas used to lift catalyst up said annular lift section.

19. The process of claim 1 wherein said feed outlets are housed in a section of said feed injector support means thermally insulated from said base portion of said feed injector support means.

* * * * *